United States Patent [19]

Mueller

[11] 4,061,066

[45] Dec. 6, 1977

[54] MULTIPLE-BLADE BAND SAW

[76] Inventor: Herold Mueller, 2377 Hayman Road, Kelowna, British Columbia, Canada

[21] Appl. No.: 762,040

[22] Filed: Jan. 24, 1977

[51] Int. Cl.[2] ..... B27B 15/08

[52] U.S. Cl. ..... 83/808; 83/819

[58] Field of Search ..... 83/808, 788, 803, 804, 83/805, 806, 816, 817, 819, 820

[56] References Cited

U.S. PATENT DOCUMENTS

| | | | |
|---|---|---|---|
| 475,328 | 5/1892 | Long | 83/808 |
| 1,125,738 | 1/1915 | Schmelzle | 83/808 |
| 1,806,672 | 5/1931 | Criner | 83/808 |
| 3,545,504 | 12/1970 | Ferrari | 83/808 |

*Primary Examiner*—Donald R. Schran

*Attorney, Agent, or Firm*—Fetherstonhaugh & Co.

[57] ABSTRACT

A band saw having a frame supporting a main shaft on which driven wheels of progressively decreasing diameter are rotatably mounted. Idler wheels are journalled on the frame and endless band saw blades are carried by the several driven and idler wheels to provide transversely spaced cutting runs along one side of the frame. Drive is transmitted to one driven wheel, thence through a system of gears to the other driven wheels to move all the cutting runs at the same speed. The driven wheels are rotatably mounted on eccentrics carried by the main shaft and the idler wheels are movable by a cam shaft arrangement relative to one another across the frame. The main shaft and cam shaft are connected by a mechanism which allows both shafts to be rotated simultaneously to shift the position of the several wheels and thus selectively adjust the spacing between the cutting runs.

5 Claims, 8 Drawing Figures

Figure 1:
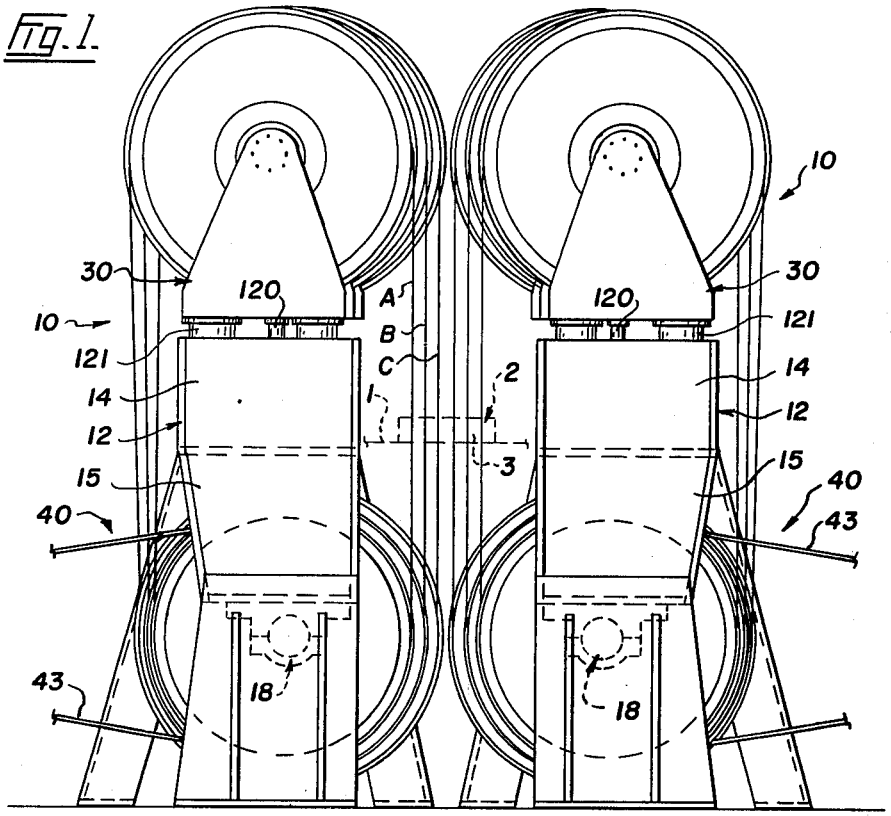

6
34
33
32
27
26
25
88
89
30
30A
30
87
120
117
121
14
83
82
84
85
85A
12
92
93
95
94
90
93
93
90
95
93
6

27
89
34
120
118
87
115
85
121
117
14
121
84
130
122
122
95
94
90
92

MULTIPLE-BLADE BAND SAW

My invention relates to a band saw having a plurality of blades which are spaced apart to saw boards or the like into smaller boards of selected widths.

The use of a band saw as a replacement for a gang saw in a mill offers certain advantages which appear to be gaining increased recognition within the wood-processing industry, but certain mechanical problems present themselves when a multi-blade band saw is employed in the production of boards. For example, it is important that the blades be readily adjustable so that boards of various widths can be cut without the necessity of shutting down the saw to manually alter the spacing between the blades. It is also important that the blades travel at the same speed and, although this can be accomplished using blade-supporting wheels of the same diameter, such wheels make it difficult to precisely control the blade settings over a reasonably wide range as is desirable. The blade should travel with a minimum amount of flexing in their cutting planes, otherwise the cuts are rough and uneven and there is a tendency for the ribbon-like blades to break.

The present invention offers a solution to the above and other related problems by providing a multi-blade band saw which can be combined with another such saw to operate as a gang saw. A sawyer operating the mill can select a width for cutting the boards and adjust the twin band saws accordingly in the very short interval required to feed a log or cant up to the blades. The means for adjusting the blade spacing provides a precise degree of control over the cutting of boards into quite a wide range of widths so that it is clearly more advantageous to use band saws as presently suggested than it is to use a conventional gang saw.

More specifically, a multiple blade band saw in accordance with the present invention comprises a frame, a main shaft rotatably mounted on the frame; large, intermediate and small driven wheels rotatably mounted on the main shaft for relative movement radially of said shaft; an idler wheel associated with each driven wheel, mounting means individually journalling the idler wheels upon the frame for relative movement laterally of said frame, an endless saw blade trained over each driven wheel and associated idler wheel, said saw blades providing parallel cutting runs normally radially spaced apart with respect to the longitudinal axis of the main shaft, drive means for rotating one driven wheel, a drive train interconnecting said one and the other driven wheels to rotate all driven wheels at substantially the same peripheral speed, and adjusting means for simultaneously shifting the relative positions of the driven and idler wheels whereby to selectively vary the radial spacing between the cutting runs.

Figure 2:
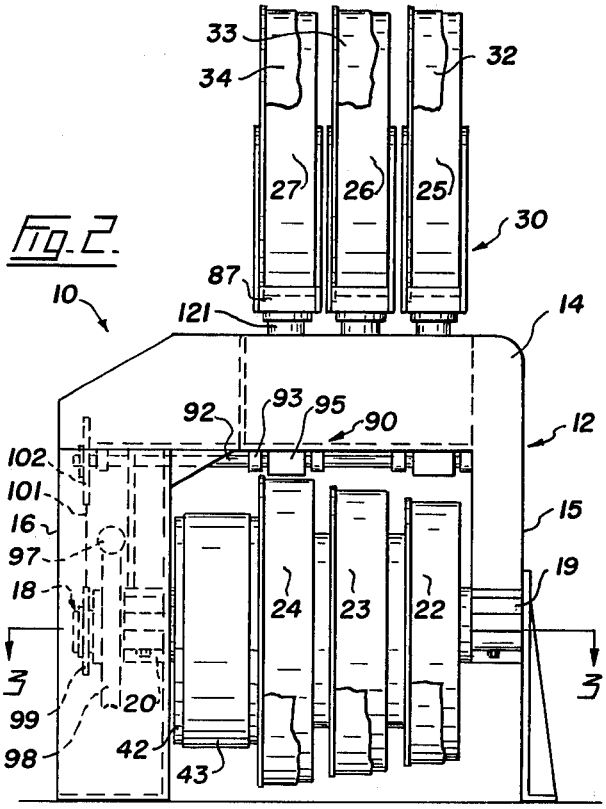
Figures 3, 4:
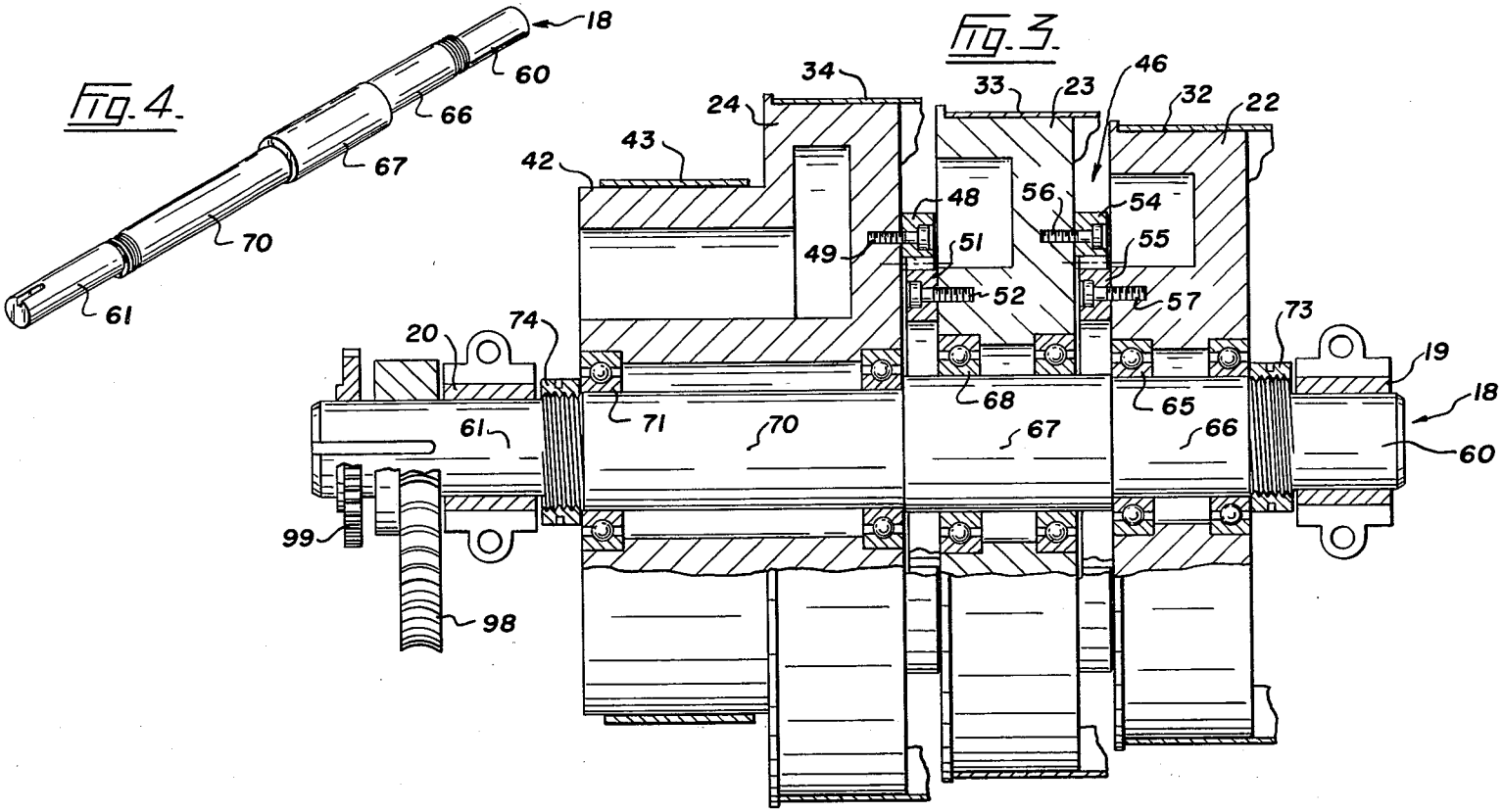
Figure 5:
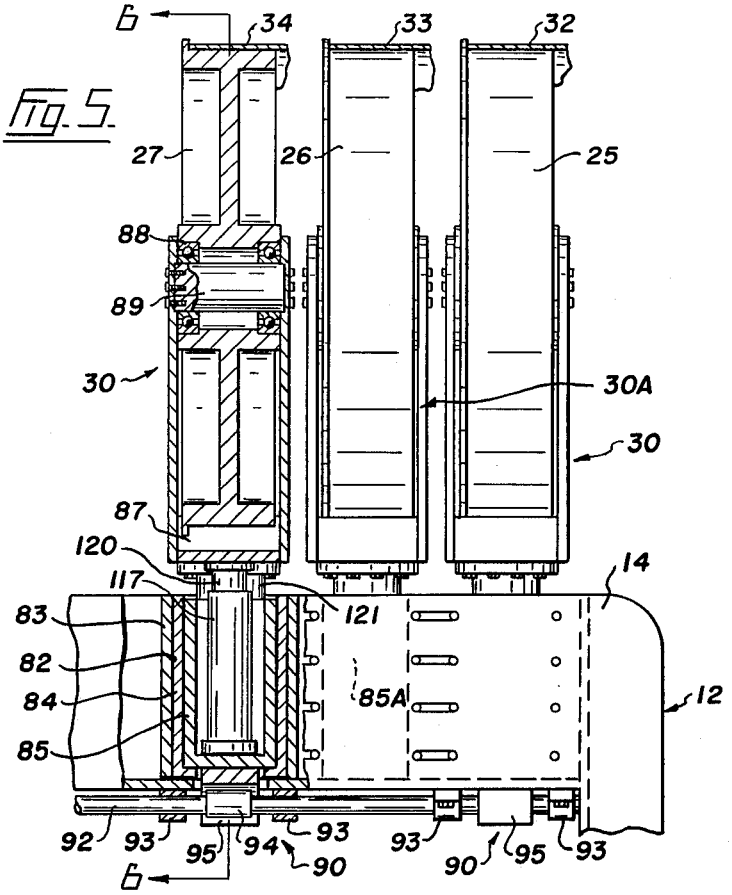
Figure 6:
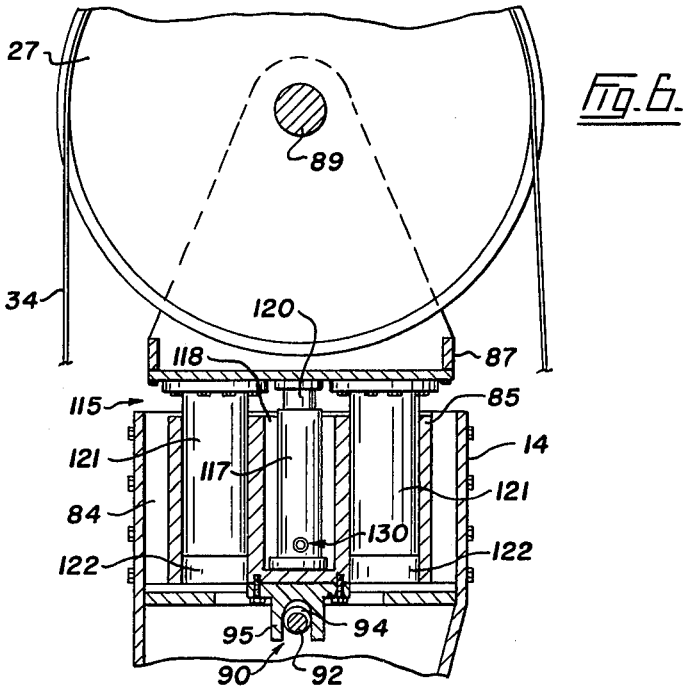
Figure 7:
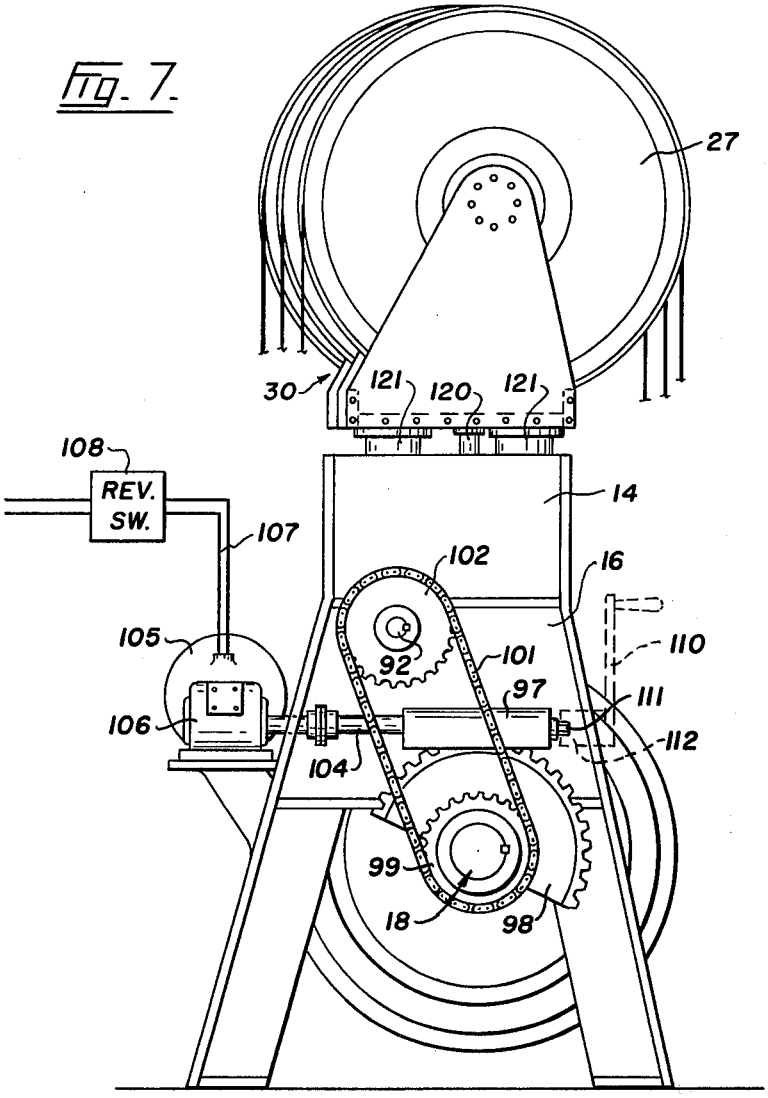
Figure 8:
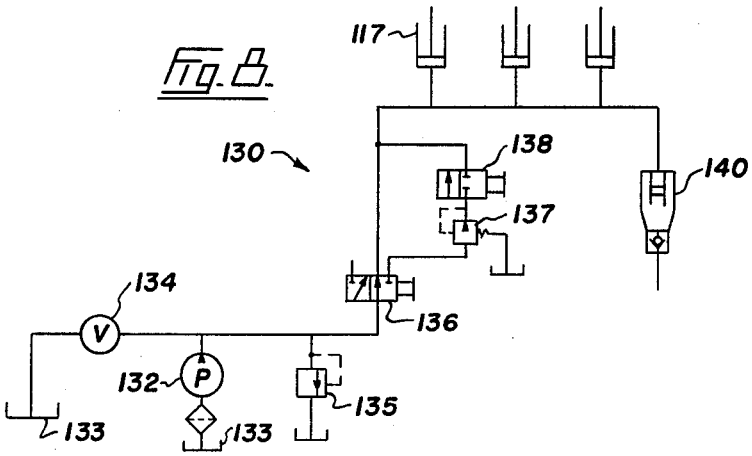

In drawings which illustrate a preferred embodiment of the invention,

FIG. 1 is a front elevation of two of the present multiple blade band saws arranged to operate as a gang saw, FIG. 2 is a side elevation of one such saw, FIG. 3 is an enlarged horizontal section taken on the line 3—3 of FIG. 2 and showing details of driven wheels which support blades of the saw, FIG. 4 is a perspective view of a shaft upon which the driven wheels are mounted, FIG. 5 is vertical section, with parts in elevation, and showing blade-supporting idler wheels of the saw, FIG. 6 is a vertical section taken on the line 6—6 of FIG. 5, FIG. 7 is a rear elevational view of the saw, and FIG. 8 is a diagram showing a hydraulic circuit for blade-tensioning means of the saw.

When two of the present saws are used as shown in FIG. 1 to do the type of cutting normally done by a gang saw, the twin saws are arranged one on either side of a feed conveyor 1, which is represented only by a dotted line in FIG. 1. The arrangement is such that a plank 2, for example, can be fed end first between the saw blades to be cut lengthwise into boards 3 of a predetermined equal width.

The numeral 10 indicates generally a multiple-blade band saw constructed in accordance with the present invention and each saw will be seen to comprise a frame 12 having a top portion 14, and front and rear portions 15 and 16 respectively. A horizontal shaft 18 is journalled in bushings 19 and 20 mounted in the vertically standing portions 15 and 16 of the frame, this shaft carrying small, intermediate and large driven wheels 22, 23, and 24.

The frame 12 also supports idler wheels 25, 26 and 27 which are vertically aligned one with each of the driven wheels. These idler wheels preferably are of the same diameter and each wheel is journalled in mounting means 30 carried by the frame portion 14. Endless band saw blades 32, 33 and 34 are supported by the driven and idler wheels, the blades being spaced apart so as to provide parallel cutting runs A, B and C vertically disposed to one side of the frame as shown in FIG. 1.

The band saw 10 is provided with drive means generally indicated at 40 for rotating the large wheel 24 upon the shaft 18. As shown best in FIGS. 1 and 2, the means 40 comprises a pulley 42 which may be integrally formed with the large wheel 24 to occupy the space between that wheel and the bearing 20. A belt 43 passes over this pulley and extends to the drive pulley (not shown) of an electric motor which preferably is used to power the present band saw. Thus, the drive from the motor is direct to wheel 24, thence to the blade 34 and idler 27, the remaining wheels and blades being operated through a drive train generally indicated at 46.

As shown in FIG. 3, the drive train 46 comprises an internal ring gear 48 which is bolted as at 49 to the face of the wheel 24. This gear meshes with an external ring gear 51 secured by bolts 52 to the adjacent face of the wheel 23. Similar gears 54 and 55 are fastened by bolts 56 and 57 to adjacent faces of the wheels 23 and 22 respectively. Thus, when the motor rotates the pulley 42 through the belt 43, drive is also transmitted from the wheel 24 to the intermediate and small wheels through the ring gear arrangement described. It should be noted that the relative pitch diameters of the several external and internal ring gears are such that all three driven wheels rotate about the shaft 18 at the same peripheral speed whereupon the cutting runs A, B and C of the saw blades travel at the same speed.

FIGS. 3 and 4 show the main shaft 18 as having end portions 60 and 61 journalled in the bushings 19 and 20 and the longitudinal axis of the shaft extends concentrically through these end portions. Bearings 65 support the wheel 22 on an eccentric portion 66 of the main shaft. A concentric portion 67 of the shaft 18 carries bearings 68 on which the wheel 23 is mounted. Finally, the shaft 18 has another eccentric portion 70 for the large wheel 24 with bearings 71 being fitted between the wheel and the shaft portion. The three driven wheels are held against movement longitudinally of the shaft by nuts 73 and 74, see FIG. 3. Thus, when the shaft 18 is given a partial turn within the bushings 19 and 20, the eccentrics 66 and 70 cause the wheels 22 and 24 to move relative to the wheel 23 and radially of the shaft. The wheel 23, of course, does not move radially since it is mounted on the concentric portion 67.

The drive wheels 22 and 24 are required to move radially of the shaft and relative to the wheel 23 when the spacing between the cutting runs A, B and C must be altered and it follows that the idler wheels must similarly be shifted upon the frame.

Therefore the mounting means 30 for the idler wheel 27 is housed within a compartment 82 provided by transverse members 83 of the top portion 14 of the frame. Compartment 82 is fitted with guide plates 84 between which an oblong block 85 is mounted for limited horizontal sliding movement laterally of the frame. A U-shaped bracket 87 is supported above the block 85 to move therewith and this bracket carries bearings 88 for a shaft 89 on which the wheel 27 is mounted.

The identically constructed mounting means 30 for the idler wheel 25 allows the idler wheel to be moved back and forth across the frame through a short distance in the same manner as wheel 27. The idler wheel 26 is supported by its mounting means 30A free to rotate but held against sliding movement within the frame. For this purpose, the mounting means 30A includes a block 85A (FIG. 5 only) which is suitably secured to the transverse frame members 83.

The band saw 10 includes adjusting means generally indicated at 90 for simultaneously shifting the relative positions of the driven and idler wheels whereby to selectively vary the transverse spacing of the cutting runs A, B and C. In FIGS. 2, 5, 6 and 7, the means 90 is shown to comprise a shaft 92 which is rotatably mounted in bearings 93 (FIG. 2 only) depending from the underside of the top portion 14 of the frame. Shaft 92 is provided with longitudinally spaced cams 94 (FIG. 6 only), there being one such cam located directly beneath each idler wheel 25 and 27. The blocks 85 below the large and small idler wheels are each fitted with a cam follower in the form of an inverted yoke 95, see particularly FIG. 6, the cams 94 being straddled by the yokes. When a partial turn is given to the cam shaft 92 in a clockwise direction (FIG. 7) the cams and yokes cooperate to move their mounting means 30 and therefore the large and small wheels 25 and 27 laterally or towards the side of the frame 12 nearest the cutting runs of the blades. A partial counterclockwise turn of the crankshaft, of course, will move the wheels 25 and 27 away from that side of the frame.

The adjusting means 90 includes a mechanism for rotating the cam shaft 92 in the required direction, see FIGS. 2 and 7. This mechanism includes a worm 97 which is mounted in the rear portion 16 of the frame so as to engage a worm gear quadrant 98 secured to the shaft 18 alongside a sprocket 19. An endless chain 101 connects the sprocket 99 to another sprocket 102 mounted on the cam shaft 92. The worm 97 has a projecting shaft 104 which is adapted to be rotated by means of a small electric motor 105 through a suitable speed reducer 106. The reversible motor 105 is included in an electric circuit 107 (FIG. 7 only) which is provided with a reversing switch 108 readily excessible to the sawyer operating the multiple-blade band saw.

Alternatively, the means 90 may simply consist of a crank 110 which is shown by dotted lines only in FIG. 7. The projecting shaft 104 has an end 111 which is hexagonal in cross section and the crank 110 has a socket 112 adapted to fit the hexagonal end of the shaft. Thus, the sawyer can adjust the saw manually and this can be done while the machine is still running if so desired.

The motor powered adjusting means 90 also allows the transverse spacing between the saw blades to be varied while the saw is still running and the blade tension can also be controlled by means generally indicated at 115. As best shown in FIG. 6, the tensioning means 115 for the wheel 27 comprises a hydraulic cylinder 117 which is mounted on the yoke 95 to extend upwardly through an opening 118 formed in the block 85. This cylinder has a piston 120 which bears against the underside of the bracket 87 carrying the idler wheel 27. The bracket has depending guide shafts 121 which slidably extend into bores 122 provided in the block 85. Cylinder 117 is included in a hydraulic circuit generally indicated at 130 and which is shown in its entirety in FIG. 8.

Referring to FIG. 8; the circuit 130 will be seen to have a pump 132, a reservoir 133, a drain valve 134, a relief valve 135, a directional valve 136, a pressure reducing valve 137, and a two way valve 138. The circuit 130 for the cylinders 117 also includes an accumulator 140 which operates to absorb any shock loads which may be imposed upon the saw blades. Full or operating pressure is set by valve 135 and a much lower pressure can be provided by setting valves 136 and 138 whereby the reduced pressure must pass through the valve 137 to the cylinders.

From the foregoing, it will be apparent there is provided an improved band saw which will do the work of a gang saw in a mill. The blade spacing can be quickly and easily adjusted by the sawyer who has before him the usual indicators which will show the setting of the blades. One plank, for example, can be run through the saw and be cut into three-quarter inch boards. A following plank can be cut into, say, 1½ inch wide boards simply by shifting an appropriate control to the required setting so that the cutting runs A and C are moved relative to the run B whereby the blades are spaced 1½ inches apart. The saw does not have to be stopped to make this adjustment and, similarly proper tension can be maintained on the blades by operation of the tensioning means.

I claim:

1. A multiple-blade band saw comprising a frame, a main shaft rotatably mounted on the frame; large intermediate and small driven wheels rotatably mounted on the main shaft for relative movement radially of said shaft; an idler wheel associated with each driven wheel, mounting means individually journalling the idler wheels upon the frame for relative movement laterally of said frame, an endless saw blade trained over each driven wheel and associated idler wheel, said saw blades providing parallel cutting runs normally radially spaced apart with respect to the longitudinal axis of the main shaft, drive means for rotating one driven wheel, a drive train interconnecting said one and the other driven wheels to rotate all driven wheels at substantially the same peripheral speed, and adjusting means for simultaneously shifting the relative positions of the driven and idler wheels whereby to selectively vary the radial spacing between the cutting runs.

2. A multiple-blade band saw as claimed in claim 1, in which said adjusting means comprises eccentrics on the main shaft for moving the large and small driven wheels relative to the intermediate driven wheel and laterally of the frame, a cam shaft journalled on the frame and having cams thereon engaging parts of the mounting means for the idler wheels associated with the large and small driven wheels, said cam shaft being partially rotated simultaneously with the driven shaft in response to operation of the adjusting means.

3. A multiple-blade band saw as claimed in claim 1, and including tensioning means for adjusting the mounting means upon the frame to apply appropriate tension to the endless saw blades.

4. A multiple-blade band saw as claimed in claim 3, in which said tensioning means comprises a hydraulic circuit having a cylinder and piston therefor mounted on the frame beneath each mounting means for the idler wheels, valve means in the hydraulic circuit for directing pressurized fluid into the cylinders to extend the pistons and move the idler wheels away from the driven wheels, and an accumulator in the hydraulic circuit for absorbing shock loads tending to move the idler wheels towards the driven wheels.

5. A multiple-blade band saw as claimed in claim 2, in which said adjusting means further comprises a worm mounted on the frame and having a projecting shaft, a gear secured to the main shaft and engaging the worm, means operatively connecting the main and cam shafts, and turning means for rotating the projecting shaft.

* * * * *